US005342733A

United States Patent [19]

Kanetake et al.

[11] Patent Number: 5,342,733

[45] Date of Patent: Aug. 30, 1994

[54] SILVER HALIDE PHOTOGRAPHIC MATERIAL

[75] Inventors: Satoshi Kanetake; Tomokazu Yasuda; Yuzou Muramatsu; Takashi Naoi, all of Kanagawa, Japan

[73] Assignee: Fuji Photo Film Co., Ltd., Kanagawa, Japan

[21] Appl. No.: 52,268

[22] Filed: Apr. 23, 1993

[30] Foreign Application Priority Data

Apr. 23, 1992 [JP] Japan ..... 4-129316

[51] Int. Cl.[5] ..... G03C 1/06

[52] U.S. Cl. ..... 430/264; 430/539; 430/536; 430/496; 430/537; 430/527; 430/950; 430/961

[58] Field of Search ..... 430/539, 536, 496, 537, 430/527, 950, 961, 264

[56] References Cited

U.S. PATENT DOCUMENTS

| | | | |
|---|---|---|---|
| 4,203,716 | 5/1980 | Chen | 430/510 |
| 4,584,255 | 4/1986 | Remley | 430/537 |
| 4,684,605 | 8/1987 | Remley | 430/537 |
| 4,822,727 | 4/1989 | Ishigaki et al. | 430/537 |
| 4,855,219 | 8/1989 | Bagchi et al. | 430/496 |
| 4,977,071 | 12/1990 | Kanetake et al. | 430/536 |
| 5,085,981 | 2/1992 | Himmelmann et al. | 430/536 |

OTHER PUBLICATIONS

Research Disclosure, Item 17643, Dec. 1978, Kenneth Mason Pub. Ltd., UK.

*Primary Examiner*—Thomas R. Neville

*Attorney, Agent, or Firm*—Sughrue, Mion, Zinn, Macpeak & Seas

[57] ABSTRACT

A silver halide photographic material has provided on a support a non-light-sensitive surface layer which contains an organic polymer represented by formula (I) and having a mean grain size of 1.0 μm or more, the polymer being produced by suspension polymerization:

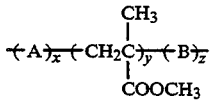

(I)

wherein A is a repeating unit obtained by polymerization of at least one monomer having two or more copolymerizable ethylenic unsaturated groups; B is a repeating unit obtained by polymerization of at least one monomer having one copolymerizable ethylenic unsaturated group; and x, y and z each represents a weight percentage, x is a number of from 1 to 40, y is a number of from 30 to 99 and z is a number of from 0 to 65. The material has good vacuum contact adhesiveness in contact exposures, and the transparency of the processed material is good.

6 Claims, No Drawings

SILVER HALIDE PHOTOGRAPHIC MATERIAL

FIELD OF THE INVENTION

The present invention relates to a silver halide photographic material. More specifically, it relates to a silver halide photographic material containing at least one matting agent.

BACKGROUND OF THE INVENTION

It is conventional to incorporate fine powdery grains (matting agent) into the protective layer of a silver halide photographic material to increase the surface roughness of the material so as to reduce self-sticking of the material, to reduce sticking of the photographic material to processing devices, and to improve the antistatic properties of the material and the vacuum adhesiveness of the material in contact exposures to prevent Newton's rings.

To reduce the vacuum contact time in contact exposures of photographic materials and to improve the transportability of such materials to satisfy desired improvements in the processability of the materials, it is necessary to enlarge the grain size of the grains of the matting agent to be incorporated into the material or to increase the amount of the matting agent to be incorporated into the material. However, such enlargement or increase causes reduction of the transparency of the photographic material (film) due to depression of the light transmission through the material or due to scattering of the light applied to the material.

In addition, increasing the surface roughness of the material would often damage the skin of the operator handling the material or damage the cylinders and other parts of devices to be used for processing the material.

Given this situation, it has been greatly desired to develop a matting agent which is effective for reducing the vacuum contact time for photographic materials and improving the adhesiveness and transportability of photographic materials while having less influence on the transparency of the material (film) and on the skin of operators handling the material, (see U.S. Pat. No. 4,855,219).

SUMMARY OF THE INVENTION

A first object of the present invention is to provide a silver halide photographic material which has good vacuum adhesiveness in contact exposures.

A second object of the present invention is to provide a silver halide photographic material which has good transparency.

A third object of the present invention is to provide a silver halide photographic material which has less undesirable influences on the skin of users.

The objects of the present invention have been attained by a silver halide photographic material having at least one light-sensitive silver halide emulsion layer and at least one non-light-sensitive surface layer on a support, in which the non-light-sensitive surface layer contains an organic polymer represented by the following formula (I) and having a mean grain size of 1.0 μm or more, the polymer being produced by suspension polymerization:

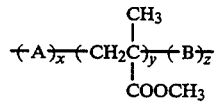

(I)

wherein

A represents a repeating unit obtained by polymerization of at least one monomer having two or more copolymerizable ethylenic unsaturated groups in the monomer molecule;

B represents a repeating unit obtained by polymerization of at least one monomer having one copolymerizable ethylenic unsaturated group in the monomer molecule; and x, y and z each represents a percentage by weight, x is a number of from 1 to 40, y is a number of from 30 to 99, and z is a number of from 0 to 65.

DETAILED DESCRIPTION OF THE INVENTION

Preferred examples of monomers having two or more ethylenic unsaturated groups which are capable of giving the repeating unit A in formula (I) include divinyl benzene, ethylene glycol dimethacrylate, diethylene glycol dimethacrylate, triethylene glycol dimethacrylate, ethylene glycol diacrylate, diethylene glycol diacrylate, 1,6-hexanediol dimethacrylate, pentaerythritol tetraacrylate, neopentyl glycol dimethacrylate, methylene-bisacrylamide, and hexamethylene-bisacrylamide. The polymer of formula (I) may contain two or more of these monomer units. Divinylbenzene, ethylene glycol dimethacrylate and pentaerythritol tetraacrylate are preferred.

Monomers which have one ethylenic unsaturated group, and are capable of giving the repeating unit B in formula (I) are not specifically limited. Preferred examples of such monomers include ethylenic unsaturated hydrocarbons and their derivatives (e.g., ethylene, propylene, 1-butene, isobutene, styrene, α-methylstyrene, vinyltoluene, vinylnaphthalene, p-methoxymethylstyrene, p-chloromethylstyrene, m-chloromethylstyrene, hydroxymethylstyrene, p-chlorostyrene), ethylenically unsaturated esters of carboxylic acids (e.g., vinyl acetate, vinyl benzoate, vinyl cinnamate, vinyl butyrate), esters of ethylenic unsaturated monocarboxylic acids or dicarboxylic acids (e.g., methyl acrylate, ethyl acrylate, hydroxyethyl acrylate, butyl acrylate, hexyl acrylate, 2-ethylhexyl acrylate, decyl acrylate, dodecyl acrylate, benzyl acrylate, ethyl methacrylate, hydroxyethyl methacrylate, butyl methacrylate, hexyl methacrylate, 2-ethylhexyl methacrylate, dodecyl methacrylate, benzyl methacrylate, cyclohexyl methacrylate, 2-(diphenylphosphorylethyl) acrylate, 2-(diphenylphosphorylethyl) methacrylate, 2-phosphorylethyl methacrylate, 2-cyanoethyl methacrylate, oligo(ethylene glycol) monomethacrylate, poly(ethylene glycol) monomethacrylate, dimethyl itaconate), monoethylenic unsaturated monocarboxylic acid or dicarboxylic acid amides (e.g., acrylamide, methacrylamide, N-methylacrylamide, N-ethylacrylamide, N,N-dimethylacrylamide, N-n-butylacrylamide, N-tert-butylacrylamide, N-tert-octylacrylamide, acrylamido-2,2-dimethylpropanesulfonic acid, itaconic acid diamide, N-isopropylacrylamide, N-acryloylmorpholine, N-acryloylpiperidine), monoethylenic unsaturated dicarboxylic acids and their salts (e.g., acrylic acid, methacrylic acid, iraconic acid), monoethylenic unsaturated compounds (e.g., acrylonitrile, methacrylonitrile), and dienes (e.g., butadiene, isoprene). The repeating unit B may be in the form of a mixture containing two or more of these monomer units. Of them, n-butyl methacrylate, styrene, acrylic acid, methacrylic acid, N-tert-butylacrylamide and benzyl methacrylate are especially preferred.

In formula (I), x is preferably from 5 to 20 wt %, especially preferably from 7 to 15 wt %; y is preferably from 50 to 95 wt %, especially preferably from 70 to 93 wt %; and z is preferably from 0 to 45 wt %, especially preferably from 0 to 23 wt %. Where the monomers capable of giving the repeating unit B are water-soluble compounds, it is especially preferred that the content of the water-soluble monomer component in the polymer be 10 wt % or less of the total weight of the polymer.

Preferred examples of compounds of formula (I) for use in the present invention are mentioned below, which, however, are not limitative.

M-1:

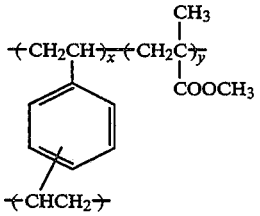

x/y = 5/95 (wt %)
mean grain size 1.3 μm

M-2:

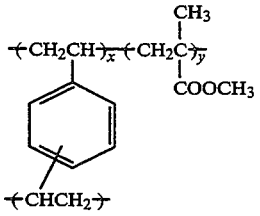

x/y = 5/95 (wt %)
mean grain size 2.5 μm

M-3:

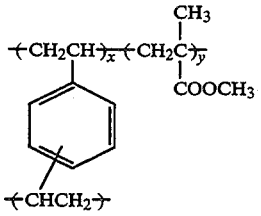

x/y = 10/90 (wt %)
mean grain size 2.0 μm

M-4:

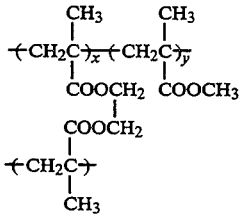

x/y = 10/90 (wt %)
mean grain size 1.9 μm

M-5:

-continued

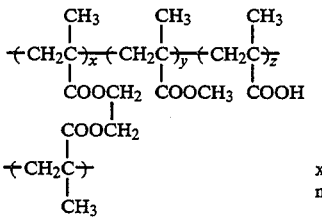

x/y/z = 15/82/3 (wt %)
mean grain size 3.2 μm

M-6:

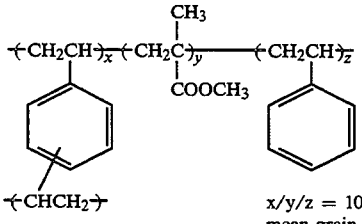

x/y/z = 10/80/10 (wt %)
mean grain size 2.5 μm

M-7:

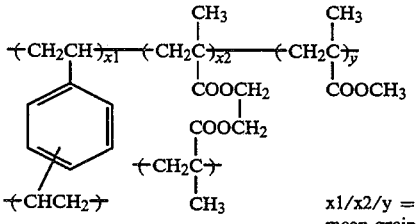

x1/x2/y = 10/5/85 (wt %)
mean grain size 2.2 μm

M-8:

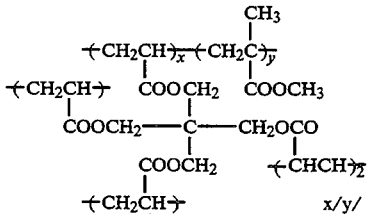

x/y/ = 5/95 (wt %)
mean grain size 1.9 μm

M-9:

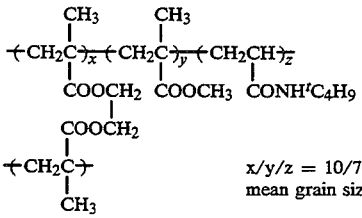

x/y/z = 10/70/20 (wt %)
mean grain size 2.9 μm

M-10:

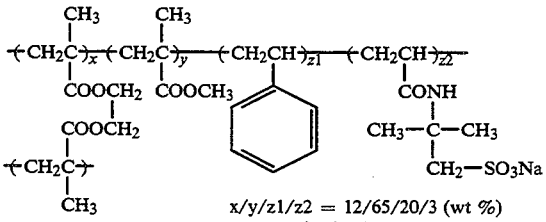

x/y/z1/z2 = 12/65/20/3 (wt %)
mean grain size 2.4 μm

M-11:

-continued

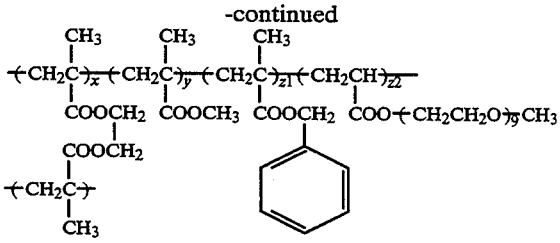

x/y/z1/z2 = 15/60/20/5 (wt %)
mean grain size 2.7 μm

M-12:

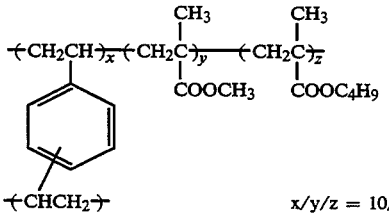

x/y/z = 10/70/20 (wt %)
mean grain size 2.3 μm

M-13:

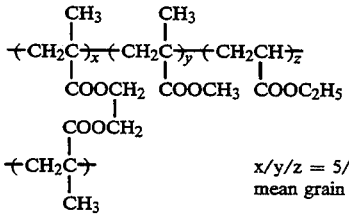

x/y/z = 5/90/5 (wt %)
mean grain size 2.9 μm

The polymer grains of formula (I) having a mean grain size of 1 μm or more for use in the present invention are those to be generally obtained by addition polymerization (so-called suspension polymerization) of the preceding monomers to be initiated by an oil-soluble polymerization initiator in a dispersion medium of water in the presence of an inorganic salt and/or dispersion stabilizer. A general method of suspension polymerization, which may apply to the present invention for producing the polymer grains, is described in T. Ohtu and M. Kinoshita, *Experimental Method of Production of Polymers* (published by Kagaku Dojin Co.), pages 130 and 146 to 147.

Inorganic salts which are preferably employed in production of the polymer grains for use in the present invention are water-soluble salts, such as sodium chloride, potassium chloride, calcium chloride, magnesium chloride, ammonium chloride, sodium sulfate, potassium sulfate, calcium sulfate, magnesium sulfate, ammonium sulfate, potassium aluminium sulfate, sodium carbonate and potassium carbonate. Of them, sodium chloride, potassium chloride, calcium chloride, sodium sulfate and magnesium sulfate are especially preferred.

The dispersion stabilizer to be preferably employed in production of the polymer grains for use in the present invention is a water-soluble high polymer compound, including, for example, polyvinyl alcohols (e.g., a commercial product sold by Shin-Etsu Chemical Co. under the trade name Shin-Etsu Poval; a commercial product sold by Nippon Synthetic Chemical Co. under the trade name Gosenol), sodium polyacrylates (e.g., a commercial product sold by Nippon Shokubai Kagaku Kogyo KK under the trade name Acrylac; commercial products sold by Nippon Pure Pharmaceuticals Co. under the trade names Aronbis and Jurimer), alkali-hydrolysates of styrene-maleic acid anhydride copolymers (e.g., a commercial product sold by Kuraray Co. under the trade name Isoban; a commercial product sold by Wako Pure Chemical Co. under the trade name Hibiswako), sodium alginate (e.g., a commercial product sold by Fuji Chemical Industry Co. under the trade name Snow Algin), and water-soluble cellulose derivatives (e.g., commercial products sold by Sansho Co. under the trade names Mayprogat, Kerco SCS and Guar Gum; a commercial product sold by Hoechst Japan Ltd. under the trade name MH-K). Of them, polyvinyl alcohols, sodium polyacrylates and alkali-hydrolysates of styrene-maleic acid anhydride copolymers are preferred.

The initiator which is preferably employed for producing the polymer grains for use in the present invention is a water-insoluble and oil-soluble polymerization initiator. Suitable initiators include, for example, azobis(cyclohexane-1-carbonitrile), azobis(isobutyronitrile), 2,2'-azobis(2,4-dimethylvaleronitrile), 2,2'-azobis(4-methoxy-2,4-dimethylvaleronitrile), 2,2'-azobis(dimethyl isobutyrate), benzoyl peroxide, tert-butyl peroxide, tert-amyl peroxide, cumyl peroxide, tert-butyl peroxybenzoate and tert-butyl peroxyphenylacetate.

For the purpose of controlling the mean grain size of the polymer grains of the present invention to a desired mean grain size in producing the grains, it is preferred to agitate the mixture comprising monomers, initiator, inorganic salt, initiator, stabilizer, water and optionally other additives by high-power agitation or a similar means to form fine liquid drops, prior to initiation of polymerization of the mixture. For suitably controlling the mean grain size of the polymer grains, it is unnecessary to specifically define and select any specific device, concentration or temperature, and any and every conventional means for polymerization may be employed.

In producing the polymer grains for use in the present invention, it is also preferred to employ a method where a part of the monomers are previously polymerized by the use of a water-soluble polymerization initiator in the presence of an emulsification stabilizer to give a fine polymer dispersion (so-called latex), then the remaining monomers are incorporated into the latex so as to enlarge the grain size of the polymer grains, and thereafter the polymerization is further continued to obtain polymer grains having a desired grain size. This is known in the art as a multi-stage swelling polymerization method.

Some specific examples of producing polymer grains for use in the present invention are mentioned below, which, however, are not limitative.

PRODUCTION EXAMPLE 1

Production of poly(divinylbenzene-co-methyl methacrylate) (Compound M-2)

1500 g of water, 2.5 g of polyvinyl alcohol (commercial product sold by Nippon Synthetic Chemical Industry Co. as Gosenol) and 30 g of sodium chloride were added to a 3-liter three-neck flask equipped with a stirrer, a thermometer and a condenser tube, well stirred and dissolved at room temperature. To the resulting solution was added a solution comprising 12.5 g of divinyl benzene, 237.5 g of methyl methacrylate and 4.0 g of benzoyl peroxide, and stirred with a high-power stirring emulsifier at a rotation rate of 5000 rpm for 20 minutes with cooling with ice to obtain a suspension. The suspension was heated up to a temperature of 80° C. with stirring at a stirring rate of 250 rpm under a nitrogen atmosphere and reacted for 7 hours under these conditions. After the reaction, the suspension was cooled to room temperature. Then, the thus obtained polymer suspension was frozen with liquid nitrogen and then thawed. The freezing and thawing cycle was repeated two times for flocculation of the polymer. The polymer grains thus formed were taken out by filtration and washed with 10 liters of 50° C. hot water to obtain 226.3 g of the intended polymer grains. The mean grain size of the grains was measured by again dispersing the grains in water followed by measuring the grain size of the dispersion with a Coulter Model N4 grain size measuring device.

PRODUCTION EXAMPLE 2

Production of poly(ethylene qlycol dimetharylate-co-methyl methacrylate) (Compound M-4)

1000 g of water and 2.5 g of sodium dodeceylbenzenesulfonate were added to a 3-iiter three-neck flask equipped with a stirrer, a thermometer and a condenser tube and dissolved at room temperature. To the resulting solution were added 2.0 g of divinylbenzene and 48 g of methyl methacrylate, and the solution was stirred at a rotation rate of 180 rpm under a nitrogen atmosphere with heating up to 85° C. Then, 0.5 g of potassium persulfate was added thereto and reacted for 4 hours to obtain a bluish white aqueous polymer dispersion. The reaction liquid was cooled to 30° C. and 20 ml of methanol was added thereto while still stirring. Subsequently, a solution formed by dissolving 3.0 g of benzoyl peroxide in 23.0 g of divinylbenzene and 177 g of methyl methacrylate was added thereto and continuously stirred for one hour. Then, an aqueous solution formed by dissolving 1.0 g of polyvinyl alcohol (the same polyvinyl alcohol as that used in preceding Production Example 1) in 500 g of water was gradually added thereto. The reaction liquid was again stirred under a nitrogen atmosphere at a rotation rate of 250 rpm with heating up to 80° C. and reacted for 7 hours. Then, the reaction liquid was cooled to room temperature. The thus obtained polymer suspension was frozen with liquid nitrogen and then thawed. The freezing and thawing cycle was repeated two times for flocculation of the polymer. The polymer grains thus formed were taken out by filtration, and washed with 5 liters of 50° C. hot water, 5 liters of an aqueous 0.1 mol/liter solution of sodium hydroxide, and 10 liters of 50° C hot water in this order to obtain 230.4 g of the intended polymer grains. The mean grain size of the grains was measured by the same method as that employed in the preceding Production Example 1.

The mean grain size of the matting agent to be used in the present invention is 1.0 μm or more, preferably from 1.0 μm to 20.0 μm.

The layer to which the matting agent of the present invention is added is most preferably the outermost non-light-sensitive surface layer of the photographic material. Where the non-light-sensitive surface layer of the material is composed of two or more layers, the matting agent may be added to any of them.

The non-light-sensitive surface layer as referred to herein indicates a non-light-sensitive hydrophilic colloid layer which is on the same side of and farther from the support than the outermost silver halide emulsion layer, i.e., the silver halide emulsion layer which is farthest from the support, or indicates a hydrophilic colloid layer which is on the side of the support opposite to the silver halide emulsion layer. Especially preferably, the non-light-sensitive surface layer is a so-called surface protective layer capable of protecting the silver halide emulsion layer on the support.

The amount of the polymer represented by formula (I) to be added to the layer is preferably from 0.5 to 400 mg/m2, especially preferably from 1 to 200 mg/m$^2$.

The photographic material of the present invention preferably contains a lubricant in the outermost surface layer.

Specific examples of lubricants usable in the present invention include, for example, silicone lubricants as described in U.S. Pat. No. 3,042,522, British Patent 955,061, U.S. Pat. Nos. 3,080,317, 4,004,927, 4,047,956, and 3,489,567, and British Patent 1,143,118; higher fatty acid lubricants, alcohol lubricants and acid amide lubricants as described in U.S. Pat. Nos. 2,454,043, 2,732,305, 2,976,148, and 3,206,311, and German Patents 1,284,295 and 1,284,294; metal soaps as described in British Patent 1,263,722 and U.S. Pat. No. 3,933,516; ester lubricants and ether lubricants as described in U.S. Pat. Nos. 2,588,765 and 3,121,060 and British Patent 1,198,387; and taurine lubricants as described in U.S. Pat. Nos. 3,502,473 and 3,042,222.

Of the lubricants, alkylpolysiloxanes and liquid paraffin which is liquid at room temperature are preferred. The amount of the lubricant to be incorporated in the photographic material of the present invention is from 0.1 to 50 % by weight, preferably from 0.5 to 30 % by weight, of the amount of the binder therein.

Specific examples of lubricants for use in the present invention are mentioned below.

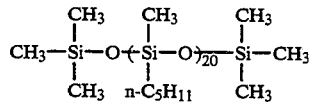
S-1

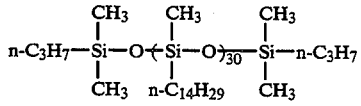
S-2

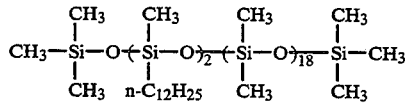
S-3

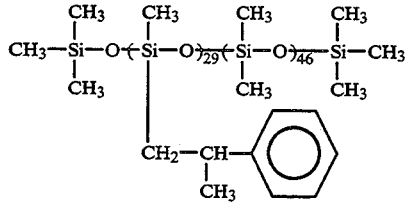
S-4

$C_9H_{19}CONHCH_2CH_2SO_3Na$ S-5

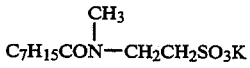
S-6

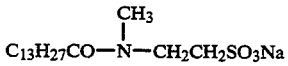
S-7

At least one of the layers constituting the photographic material of the present invention preferably has a surface resistivity of $10^{12}$ Ω or less at 25° C. and 25% RH.

In other words, the photographic material of the present invention preferably has an electroconductive layer.

Electroconductive substances to be incorporated in the electroconductive layer include, for example, electroconductive metal oxides and electroconductive high polymer compounds.

Preferred electroconductive metal oxides for use in the present invention are crystalline metal oxide grains. In particular, those having oxygen defects and those containing a small amount of hetero atoms capable of forming a donor to the metal oxide base are especially preferred, as they are, in general, highly electroconductive. Especially, the latter are more preferred as they do not cause fogging of the silver halide emulsions constituting the photographic material. Examples of usable metal oxides include ZnO, $TiO_2$, $SnO_2$, $Al_2O_3$, $In_2O_3$, $SiO_2$, MgO, BaO, $MoO_3$, $V_2O_5$ and composite oxides of these oxides. ZnO, $TiO_2$ and $SnO_2$ are especially preferred. Examples of usable metal oxides capable of containing hetero atoms include: addition of Al and In to ZnO, addition of Sb, Nb and halogen elements to $SnO_2$, and addition of Nb and Ta to $TiO_2$. The amount of these hetero atoms to be incorporated in the metal oxides is preferably from 0.01 mol % to 30 mol %, especially preferably from 0.1 mol % to 10 mol %.

Fine grains of such metal oxides for use in the present invention are electroconductive, and the volume resistivity thereof is preferably $10^7$ Ω-cm or less, especially preferably $10^5$ Ω-cm.

Such metal oxides are described in, for example, JP-A-56-143431, JP-A-56-120519 and JP-A-58-62647.

Preferred examples of electroconductive high polymer compounds for use in the present invention include, for example, polyvinylbenzenesulfonates, polyvinylbenzyltrimethylammonium chlorides; quaternary salt polymers as described in U.S. Pat. Nos. 4,108,802, 4,118,231, 4,126,467, and 4,127,217; and polymer latexes as described in U.S. Pat. No. 4,070,189, German OLS 2,830,767, and JP-A-61-296352 and JP-A-61-62033.

Specific examples of electroconductive high polymer compounds usable in the present invention are mentioned below, which, however, are not limitative.

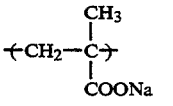

P-1

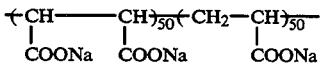

P-2

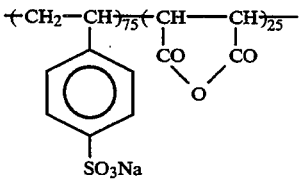

P-3

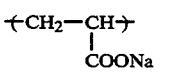

P-4

-continued

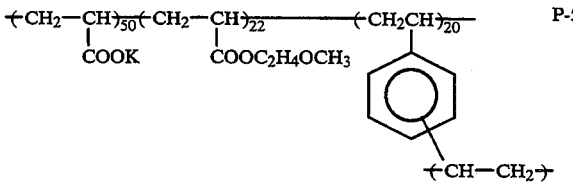

P-5

The amount of the electroconductive metal oxide or electroconductive high polymer compound to be incorporated in the photographic material of the present invention is preferably from 0.05 to 20 g, especially preferably from 0.1 to 10 g, per $m^2$ of the material. The electroconductive layer of the material preferably has a surface resistivity of $10^{12}$ Ω or less, especially preferably $10^{11}$ Ω or less, at 25° C. and 25% RH. Due to the presence of the electroconductive layer, the material may have an excellent antistatic property.

Combination of a fluorine-containing surfactant with the preceding electroconductive substance gives a better antistatic property to the photographic material of the invention.

Preferred examples of fluorine-containing surfactants for use in the present invention include those having a fluoroalkyl, alkenyl or aryl group with 4 or more carbon atoms and having, as an ionic group, an anionic group (e.g., sulfonic acid or sulfonates, sulfuric acid or sulfates, carboxylic acid or carboxylates, phosphoric acid or phosphates), a cationic group (e.g., amine salts, ammonium salts, aromatic amine salts, sulfonium salts, phosphonium salts), a betaine group (e.g., carboxyamine salts, carboxyammonium salts, sulfoamine salts, sulfoammonium salts, phosphoammonium salts), or a nonionic group (e.g., substituted or unsubstituted polyoxyalkylene groups, polyglyceryl groups, sorbitan residues).

Such fluorine-containing surfactants are described in, for example, JP-A-49-10722, British Patent 1,330,356, U.S. Pat. Nos. 4,335,201 and 4,347,308, British Patent 1,417,915, JP-A-55-149938, and JP-A-58-196544, and British Patent 1,439,402.

Specific examples of fluorine-containing surfactants are mentioned below.

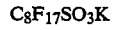

F-1

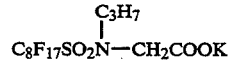

F-2

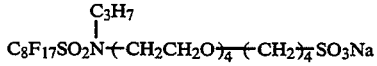

F-3

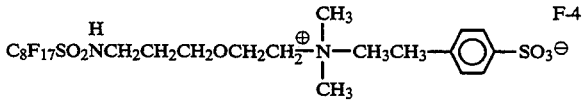

F-4

For increasing contrast of the silver halide photographic material of the present invention, hydrazine derivatives of the following general formula (II) or tetrazolium compounds may be employed:

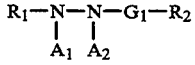

(II)

wherein $R_1$ represents an aliphatic group or an aromatic group;

$R_2$ represents a hydrogen atom, an alkyl group, an aryl group, an alkoxy group, an aryloxy group, an amino group or a hydrazino group;

$G_1$ represents —CO—, —$SO_2$—, —SO—, —P(O)($R_2$)—, —CO—CO—, a thiocarbonyl group or an iminomethylene group; and both $A_1$ and $A_2$ are hydrogen atoms or one of them is a hydrogen atom and the other is a substituted or unsubstituted alkylsulfonyl group, a substituted or unsubstituted arylsulfonyl group, or a substituted or unsubstituted acyl group.

Hydrazine derivatives of formula (II) and other hydrazine derivatives employable in the present invention are described in the following references:

JP-A-2-12236, from page 2, right top column, line 19 to page 7, right top column, line 3; JP-A-3-174143, from page 20, right bottom column, line 1 to page 27, right top column, line 20, formula (II) and Compounds (II-1) to (II-54).

Examples of tetrazolium compounds employable in the present invention include those described in JP-A-63-314541.

The photographic material of the present invention may include a subbing layer.

The subbing layer contains a vinylidene chloride copolymer, preferably having from 70 to 99.9% by weight, more preferably from 85 to 99% by weight, of vinylidene chloride.

Specific examples of vinylidene chloride copolymers employable in the present invention are mentioned below. (The parenthesized ratio indicates % by weight.)

V-1: Vinylidene chloride/acrylic acid/methyl acrylate (90/1/19)

V-2: Vinylidene chloride/acrylic acid/methyl methacrylate (90/1/9)

V-3: Vinylidene chloride/methacrylic acid/methyl methacrylate (90/0.5/9.5)

V-4: Vinylidene chloride/methacrylic acid/methyl methacrylate/glycidyl methacrylate/acrylonitrile (90/0.5/3.5/3/3)

V-5: Aqueous dispersion of core/shell type latex (90 wt % of core; 10 wt % of shell)

core: vinylidene chloride/methyl acrylate/methyl methacrylate/acrylonitrile/acrylic acid (93/3/3/0.9/0.1)

shell: vinylidene chloride/methyl acrylate/methyl methacrylate/acrylonitrile/acrylic acid (90/3/3/2/2)

Other additives to be incorporated in the photographic material of the present invention and methods of processing it are not specifically limited. For instance, the disclosures of the following references are referred to.

| | References |
|---|---|
| 1) Silver halide emulsions and methods of preparing them | JP-A-2-97937, from page 20, right bottom column, line 12 to page 21, left bottom column, line 14; JP-A-2-12236, from page 7, right top column, line 19 to page 8, left bottom column, line 12. |
| 2) Color sensitizing dyes | JP-A-2-12236, page 8, from left bottom column, line 13 to right bottom column, line 4; JP-A-2-103536, from page 16, right bottom column, line 3 to page 17, left bottom column, line 20; color sensitizing dyes in JP-A-1-112235, JP-A-2-124560, and JP-A-3-7928. |
| 3) Surfactants | JP-A-2-12236, page 9, from right top column, line 7 to right bottom column, line 7; JP-A-2-18542, from page 2, left bottom column, line 13 to page 4, right bottom column, line 18 |
| 4) Antifoggants | JP-A-2-103536, from page 17, right bottom column, line 19 to page 18, right top column, line 4, and right bottom column, lines 1 to 5; thiosulfinic acid compounds in JP-A-1-237538 |
| 5) Polymer latexes | JP-A-2-103536, page 18, left bottom column, lines 12 to 20 |
| 6) Acid group-having compounds | JP-A-2-103536, from page 18, right bottom column line 6 to page 19, left top column, line 1 |
| 7) Hardening agents | JP-A-2 103536, page 18, right top column, lines 5 to 17 |
| 8) Dyes | Dyes in JP-A-2-103536, page 17, right bottom column, lines 1 to 18; and solid dyes in JP-A-2-294683 |
| 9) Binders | JP-A-2-18542, page 3, right bottom column, lines 1 to 20 |
| 10) Nucleation accelerators | JP-A-2-103536, page 9, right top column, lines 13 to 16, formulae (II-m) to (II-p) in page 16, left top column, and Compounds (II-1) to (II-22); compounds in JP-A-1-179939 |
| 11) Black pepper inhibitors | Compounds in U.S. Pat. No. 4,956,257 and JP-A-1-118832 |
| 12) Redox compounds | JP-A-2-301743, compounds of formula (I), especially Compounds 1 to 50; JP-A-3-174143, formulae (R-1), (R-2) and (R-3) and Compounds 1 to 75 in pages 2 to 20; compounds in EP495477. |
| 13) Monomethine compounds | JP-A-2-287532, compounds of formula (II), especially Compounds (II-1) to (II-26) |
| 14) Dihydroxybenzenes | JP-A-3-39948, from page 11, left top column to page 12, left bottom column; compounds in EP 452772A |
| 15) Developers and methods of development | JP-A-2-103536, from page 19, right top column, line 16 to page 21, left top column, line 8 |

The present invention will be explained in more detail by way of the following examples, which, however, are not intended to restrict the scope of the present invention.

EXAMPLE 1

The following first subbing layer and second subbing layer were coated on both surfaces of a biaxially stretched polyethylene terephthalate support having a thickness of 100 μm in this order, to form subbed samples Nos. 1 to 14.

| (1) Formulation of First Subbing Layer: | |
|---|---|
| Vinylidene chloride latex (V-5) | 15 wt. pts. |
| 2,4-Dichloro-6-hydroxy-1,3,5-triazine sodium salt | 0.2 wt. pt. |
| Colloidal silica (Snowtex ZL, produced by Nissan Chemical Co.) | 1.1 wt. pts. |
| Fine polystyrene grains (mean grain size 3 μm) | 5 mg/$m^2$ |
| Distilled water to make | 100 wt. pts. |
| 10 wt % KOH to make | pH of 6 |
| Temperature of coating liquid | 10° C. |
| Dry thickness | See Table 1 |
| Drying condition | 180° C., 2 min. |

-continued (2) Formulation of Second Subbing Layer:

| | |
|---|---|
| Gelatin | 1 wt. Pt. |
| Methyl cellulose | 0.05 wt. pt. |
| Compound (a) | 0.02 wt. pt. |

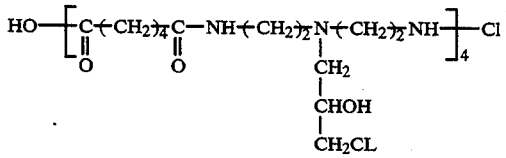

| | |
|---|---|
| $C_{12}H_{25}O(CH_2CH_2O)_{10}H$ | 0.03 wt. pt. |
| Compound (b) | $3.5 \times 10^{-3}$ wt. pt. |

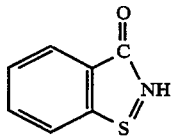

| | |
|---|---|
| Acetic acid | 0.2 wt. pt. |
| $H_2O$ to make | 100 wt. pts. |
| Temperature of coating liquid | 25° C. |
| Dry thickness | 0.1 g/m$^2$ |
| Drying condition | 170° C., 2 min. |

Preparation of Emulsion

An aqueous silver nitrate solution and an aqueous sodium chloride solution containing $4\times10^{-5}$ mol, per mol of silver, of $(NH_4)_2Rh(H_2O)Cl_5$ were simultaneously added to an aqueous gelatin solution at 40° C. over a period of 3.5 minutes, while controlling the potential at 95 mV, to form core grains of 0.11 μm. Next, an aqueous silver nitrate solution and an aqueous sodium chloride solution containing $1.2\times10^{-4}$ mol, per mol of silver, of $(NH_4)_2Rh(H_2O)Cl_5$ were simultaneously added thereto over a period of 7 minutes, while controlling the potential at 94 mV. After addition of the aqueous halide solution, 5,6-cyclopentane-4-hydroxy-1,3,3a,7-tetrazaindene ($5\times10^{-3}$ mol per mol of silver) was added to the reaction system so as to stop the physical ripening of it. Thus, cubic silver chloride grains having a mean grain size of 0.14 μm were prepared.

Formation of Coated Samples

To the emulsion were added 24 mg/m$^2$ of 5,6-cyclopentane-4-hydroxy-1,3,3a,7-tetrazaindene, 770 mg/m$^2$ of ethyl acrylate latex (mean grain size 0.05 μm), 3 mg/m$^2$ of a compound of the following structural formula:

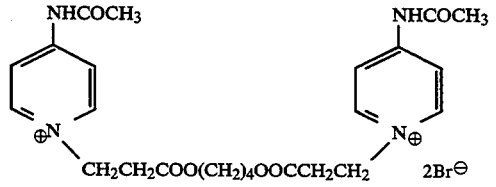

and, as a hardening agent, 126 mg/m$^2$ of 2-bis(vinyl-sulfonylacetamido)ethane, to prepare a coating liquid. This was coated on the preceding support in an amount of 3.0 g/m$^2$ as silver. The amount of gelatin coated was 1.5 g/m$^2$.

Over this, a lower protective layer composed of 0.8 g/m$^2$ of gelatin, 8 mg/m$^2$ of lipoic acid, 6 mg/m$^2$ of $C_2H_5SO_2SNa$ and 230 mg/m$^2$ of ethyl acrylate latex (mean grain size 0.05 μm), was coated. In addition, an upper protective layer composed of 0.7 g/m$^2$ of gelatin and 75 mg/m$^2$ of a compound of the following structural formula:

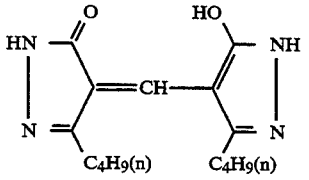

75 mg/m$^2$ was coated thereover, the compound being dispersed in gelatin as a solid. To the upper protective layer, a matting agent as indicated in Table 1 below was added along with 135 mg/m$^2$ of methanol silica (mean grain size 0.02 μm), 25 mg/m$^2$ of sodium dodecylbenzenesulfonate as a coating aid, 20 mg/m$^2$ of oxyethylene nonylphenyl ether sodium sulfate and 3 mg/m$^2$ of N-perfluorooctanesulfonyl-N-propylglycine potassium salt. Thus, coated samples were formed.

The backing layer and the protective layer over the backing layer each had the composition mentioned below. The swelling percentage of the thus coated back surface of the support was 110%.

| Formulation of Backing Layer: | |
|---|---|
| Gelatin | 170 mg/m$^2$ |
| Sodium Dodecylbenzenesulfonate | 32 mg/m$^2$ |
| Sodium dihexyl-α-sulfosuccinate | 35 mg/m$^2$ |
| $SnO_2$/Sb (9/1, by weight; mean grain size, 0.25 μm) | 318 mg/m$^2$ |
| Formulation of Protective Layer over Backing Layer: | |
| Gelatin | 2.7 g/m$^2$ |
| Fine polymethyl methacrylate grains (mean grain size 7.5 μm) | 10 g/m$^2$ |
| Sodium dihexyl-α-sulfosuccinate | 20 g/m$^2$ |
| Sodium dodecylbenzenesulfonate | 67 g/m$^2$ |
| $C_8F_{17}SO_2N(C_3H_7)-(CH_2CH_2O)_n-(CH_2)_4-SO_3Li$ | 5 mg/m$^2$ |
| Dye (A) | 190 mg/m$^2$ |

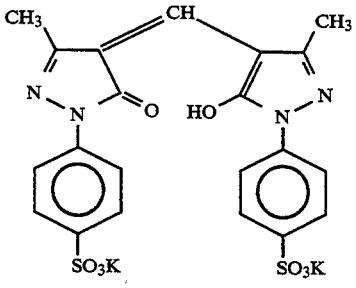

| | |
|---|---|
| Dye (B) | 32 mg/m$^2$ |

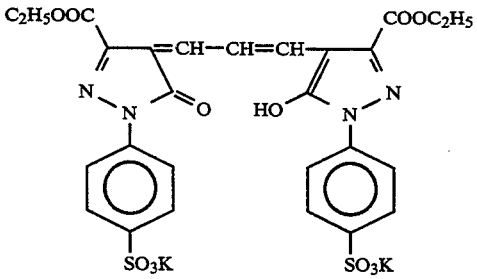

-continued

Dye (C) 59 mg/m²

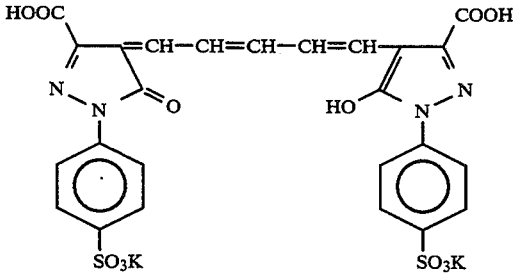

| | |
|---|---|
| Ethyl acrylate latex (mean grain size 0.05 μm) | 260 g/m² |
| 1,3-Divinylsulfonyl-2-propanol | 149 g/m² |

The samples thus formed were left as they were under an atmosphere of 25° C. and 60% RH for 10 days, and they were examined with respect to vacuum contact adhesiveness, ease of scratching, haze, and sticking resistance by the methods mentioned below.

(1) Evaluation of Vacuum Contact Adhesiveness

Using a printer for contact exposure, the sample to be tested (40 cm×50 cm) was attached to a film of an original flat-dot image (35 cm×45 cm) of 10% dot image area under a vacuum degree of −650 mmHg and subjected to contact exposure under these conditions. This sample was then developed. The vacuum drawing time necessary to obtain a uniform printed dot image of 90% was determined. The shorter the vacuum drawing time, the better the vacuum contact adhesiveness.

(2) Evaluation of Ease of Scratching (A) A sample was prepared by coating 10 g/m² of gelatin on a 100 μm polyester support.

(B) The sample to be tested was exposed on the whole surface thereof and developed to prepare a black solid sample.

Two samples (A) and (B) were left in an atmosphere of 25° C and 30% RH for 2 hours, and they were attached to each other in such a way that the gelatin surface of Sample (A) faced to the matting agent-containing surface of Sample (B). They were rubbed with each other five times by reciprocating movement, while applying a load of 50 g thereto.

The amount of the gelatin powder as peeled off by the matting agent was determined by sensory evaluation. On the basis of the determination, the samples were evaluated by five-rank evaluation of from 1 to 5 where 1 was the worst and 5 was the best.

(3) Evaluation of Haze

Non-exposed samples were developed. Using the developed samples, the haze of each sample was measured by the use of a haze tester NDH300A (manufactured by Nippon Denshoku Kogyo KK).

(4) Evaluation of Sticking Resistance

The sample to be tested (4 cm×4 cm) was left in an atmosphere of 25° C. and 78% RH for 2 hours. Five sheets of the sample were piled up in the same atmosphere and sandwiched between a pair of glass plates and put in a moisture-proof bag. While applying a load of 1.2 kg thereto, the bag was left as it was at 40° C. for one day. Three of the five sheets were taken out, and the stuck areas of them were visually inspected. Thus, each sample was evaluated by five-rank evaluation of from 1 to 5 where 1 was the worst and 5 was the best.

The test results obtained are shown in Table 1 below.

TABLE 1

| Sample No. | Matting Agent: Compound No. | Matting Agent: Production Method | Matting Agent: Cross-linking | Matting Agent: Amount Coated (mg/m²) | Vacuum Contact Adhesiveness (sec) | Ease of Scratching | Haze | Sticking Resistance |
|---|---|---|---|---|---|---|---|---|
| 1-1 (Invention) | M-2 | suspension polymerization | yes | 30 | 50 | 5 | 6.0 | 5 |
| 1-2 (Invention) | M-5 | suspension polymerization | yes | 30 | 40 | 5 | 4.9 | 5 |
| 1-3 (Comparison) | M-2 | emulsion polymerization | yes | 30 | 60 | 5 | 9.7 | 5 |
| 1-4 (Comparison) | M-5 | emulsion polymerization | yes | 30 | 50 | 5 | 8.3 | 5 |
| 1-5 (Comparison) | N-1 | suspension polymerization | no | 30 | 90 | 3 | 7.5 | 2 |
| 1-6 (Comparison) | N-2 | suspension polymerization | no | 30 | 70 | 2 | 7.0 | 2 |
| 1-7 (Comparison) | N-3 | suspension polymerization | yes | 30 | 52 | 3 | 5.8 | 3 |
| 1-8 (Comparison) | N-4 | suspension polymerization | yes | 30 | 42 | 3 | 4.8 | 4 |
| 1-9 (Comparison) | N-5 | — | — | 30 | 55 | 1 | 10.5 | 5 |
| 1-10 (Comparison) | N-6 | — | — | 30 | 50 | 1 | 9.2 | 5 |
| 1-11 (Invention) | M-2 | suspension polymerization | yes | 10 | 60 | 5 | 4.5 | 5 |
| 1-12 (Invention) | M-2 | suspension polymerization | yes | 50 | 38 | 5 | 7.1 | 5 |
| 1-13 (Comparison) | N-1 | suspension polymerization | no | 50 | 72 | 2 | 9.6 | 4 |
| 1-14 (Comparison) | N-5 | — | — | 10 | 68 | 1 | 7.8 | 5 |
| 1-15 (Comparison) | N-5 | — | — | 50 | 40 | 1 | 12.4 | 5 |

As is noted from the results in Table 1 above, the samples of the present invention are all superior to the comparative samples with respect to vacuum contact adhesiveness, scratching resistance, hazing resistance and sticking resistance.

Compounds (N-1) to (N-6) are as follows:

N-1:

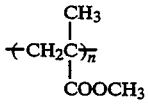

grain size 2.5 μm

N-2:

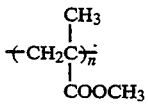

grain size 3.5 μm

N-3:

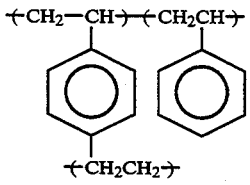

grain size 2.5 μm

N-4:

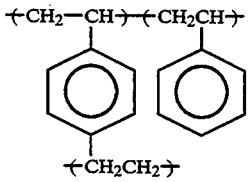

grain size 3.5 μm

N-5:

$(SiO_2)_n$ grain size 2.5 μm

N-6:

$(SiO_2)_n$ grain size 3.5 μm

EXAMPLE 2

The same support as that in Example 1 was used. On one surface of the support, an electroconductive layer and a backing layer each having the formulation (3) and formulation (4) mentioned below, respectively, were coated simultaneously by multi-layer coating.

| | |
|---|---|
| Formulation (3) for electroconductive layer: | |
| $SnO_2/Sb$ (9/1, by weight; mean grain size 0.25 μm) | 300 mg/m$^2$ |
| Gelatin | 170 mg/m$^2$ |
| Compound (30) | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| Formulation (4) for backing layer: | |
| Gelatin | 2.9 g/m$^2$ |
| Compound (31) | 300 mg/m$^2$ |
| Compound (32) | 50 mg/m$^2$ |
| Compound (33) | 50 mg/m$^2$ |
| Compound (30) | 10 mg/m$^2$ |
| Sodium dodecylbenzenesulfonate | 70 mg/m$^2$ |
| Sodium dibenzyl-α-sulfosuccinate | 15 mg/m$^2$ |
| 1,1'-Bis(vinylsulfonyl)methane | 150 mg/m$^2$ |
| Ethyl acrylate latex (mean grain size 0.05 μm) | 500 mg/m$^2$ |
| Lithium perfluorooctanesulfonate | 10 mg/m$^2$ |
| Fine polymethyl methacrylate grains (mean grain size 7.4 μm) | 10 mg/m$^2$ |

Compounds (30) to (33) are as follows:

Compound (30):

-continued

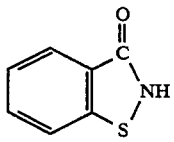

Compound (31):

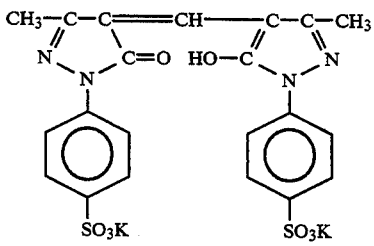

Compound (32):

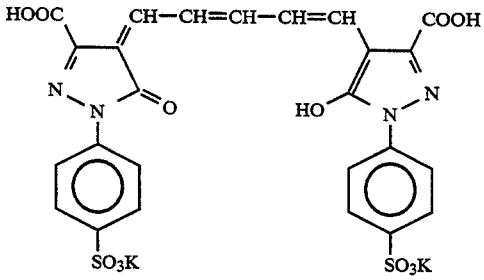

Compound (33):

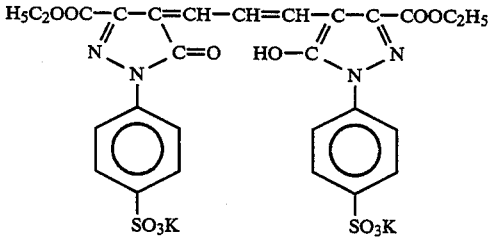

On the opposite surface of the support, silver halide emulsion layers (1) and (2) and protective layers (2) and (3) each having the formulations (5), (6), (7) and (8) mentioned below, respectively, were coated in this order.

Formulation (5) for Silver Halide Emulsion Layer (1)

Solution (I): 300 ml of water, 9 g of gelatin

Solution (II): 100 g of $AgNO_3$, 400 ml of water

Solution (III): 37 g of NaCl, 1.1 ml of $(NH_4)_3RhCl_6$, 400 ml of water

Solution (II) and Solution (III) were simultaneously added to Solution (I) at 45° C., each at a constant rate. Soluble salts were removed from the emulsion thus formed by an ordinary method. Gelatin was added to the emulsion, and, as a stabilizer, 6-methyl-4-hydroxy1,3,3a,7-tetrazaindene was added thereto. The emulsion formed was a monodispersed emulsion having a mean grain size of 0.20 μm. The gelatin content in one kg of the emulsion was 60 g.

The following compounds were added to the thus formed emulsion.

| | |
|---|---|
| Compound (34) | $6 \times 10^{-3}$ mol/mol of Ag |
| Compound (35) | 60 mg/m$^2$ |
| Compound (36) | 9 mg/m$^2$ |

-continued

| | |
|---|---|
| Compound (30) | 10 mg/m$^2$ |
| Sodium polystyrenesulfonate | 40 mg/m$^2$ |
| N-Oleoyl-N-methyltaurine sodium salt | 50 mg/m$^2$ |
| 1,1'-Bis(vinylsulfonyl)methane | 70 mg/m$^2$ |
| 1-Phenyl-5-mercaptotetrazole | 3 mg/m$^2$ |
| Ethyl acrylate latex (mean grain size 0.05 μm) | 0.46 g/m$^2$ |

The coating liquid thus prepared was coated on the support in an amount of 1.3 g/m$^2$ as silver.

Compounds (34) to (36) are as follows:

Compound (34):

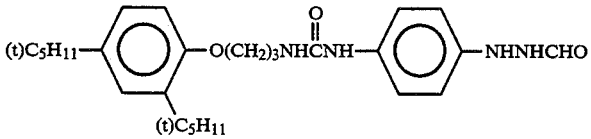

Compound (35):

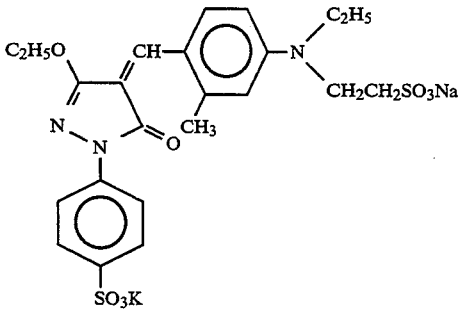

Compound (36):

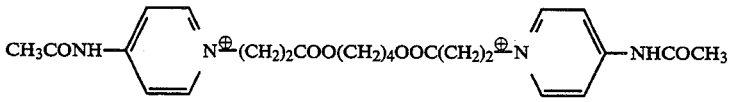

Formulation (6) for Silver Halide Emulsion Layer (2)

Solution (I): 300 ml of water, 9 g of gelatin

Solution (II): 100 g of $AgNO_3$, 400 ml of water

Solution (III): 37 g of NaCl, 2.2 mg of $(NH_4)_3RhCl_6$, 400 ml of water

In the same manner as in preparation of the preceding formulation (5), Solution (II) and Solution (III) were simultaneously added to Solution (I) to prepare an emulsion. This was a monodispersed emulsion having a mean grain size of 0.20 μm.

The following compounds were added to the emulsion.

| Emulsified dispersion of hydrazine derivative | |
|---|---|
| Compound (34) | $5 \times 10^{-3}$ mol/mol of Ag |
| Compound (35) | 60 mg/m$^2$ |
| Compound (36) | 9 mg/m$^2$ |
| Compound (30) | 10 mg/m$^2$ |
| Sodium polystyrenesulfonate | 50 mg/m$^2$ |
| N-oleoyl-N-methyltaurine sodium salt | 40 mg/m$^2$ |
| 1,1'-Bis(vinylsulfonyl)methane | 80 mg/m$^2$ |
| 1-Phenyl-5-mercaptotetrazole | 3 mg/m$^2$ |
| Ethyl acrylate latex (mean grain size 0.05 μm) | 0.40 g/m$^2$ |

The coating liquid thus prepared was coated over the emulsion layer (1) in an amount of 1.3 g/m$^2$ as silver.

| Formulation (7) for Protective Layer (2): | |
|---|---|
| Gelatin | 1.0 g/m$^2$ |
| Lipoic acid | 5 mg/m$^2$ |
| Sodium dodecylbenzenesulfonate | 5 mg/m$^2$ |
| Compound (37) | 20 mg/m$^2$ |
| Sodium polystyrenesulfonate | 10 mg/m$^2$ |
| Compound (38) | 20 mg/m$^2$ |
| Ethyl acrylate latex (mean grain size 0.05 μm) | 200 mg/m$^2$ |
| **Formulation (8) for Protective Layer (3):** | |
| Gelatin | 1.0 g/m$^2$ |
| Matting agent | See Table 2 |
| Sodium dodecylbenzenesulfonate | 20 mg/m$^2$ |
| Potassium perfluorooctanesulfonate | 10 mg/m$^2$ |
| N-perfluorooctanesulfonyl-N-propylglycine potassium salt | 3 mg/m$^2$ |
| Sodium Polystyrenesulfonate | 2 mg/m$^2$ |
| Poly(polymerization degree 5) oxyethylene nonylphenyl ether sodium sulfate ester | 20 mg/m$^2$ |

Preparation of Emulsified Dispersion of Hydrazine Derivative:

| Solution (I): | |
|---|---|
| Compound (34) | 3.0 g |
| Compound (39) | 1.5 g |
| Poly(N-tert-butylacrylamide) | 6.0 g |
| Ethyl acetate | 30 ml |
| Sodium dodecylbenzenesulfonate (72% methanol solution) | 0.12 g |
| Water | 0.12 ml |

These were heated up to 65° C. and dissolved uniformly to prepare Solution (I).

| Solution (II): | |
|---|---|
| Gelatin | 12 g |
| Compound (30) | 0.02 g |
| Water | 108 ml |

These were heated up to 65° C. and dissolved uniformly to prepare Solution (II).

Compounds (37) to (39) are as follows:

Compound (37):

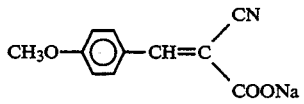

Compound (38):

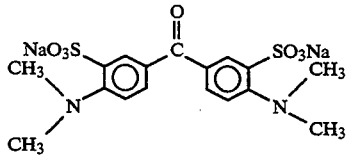

Compound (39):

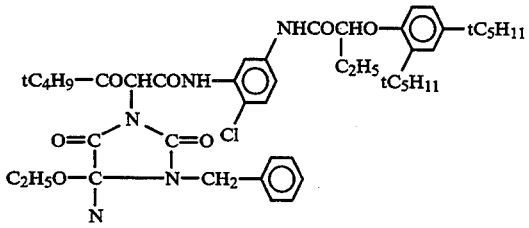

Solution (I) and Solution (II) were blended and agitated at a high agitation rate in a homogenizer (manufactured by Nippon Seiki Seisakusho) to obtain an emulsified dispersion of fine grains. The emulsion was subjected to hot distillation under reduced pressure to remove ethyl acetate therefrom. 250 g of water was added to the distilled residue, the content of the remaining ethyl acetate being 0.2%.

The samples thus formed were examined by the same methods as in Example 1. The test results are shown in Table 2 below. The results in Table 2 show that the samples of the present invention were all superior to the comparative samples, with respect to vacuum contact adhesiveness, scratching resistance, hazing resistance and sticking resistance.

TABLE 2

| Sample No. | Matting Agent: Compound No. | Matting Agent: Production Method | Matting Agent: Cross-linking | Matting Agent: Amount Coated (mg/m²) | Vacuum Contact Adhesiveness (sec) | Ease of Scratching | Haze | Sticking Resistance |
|---|---|---|---|---|---|---|---|---|
| 2-1 (Invention) | M-2 | suspension polymerization | yes | 30 | 53 | 5 | 5.6 | 5 |
| 2-2 (Invention) | M-5 | suspension polymerization | yes | 30 | 42 | 5 | 4.4 | 5 |
| 2-3 (Comparison) | M-2 | emulsion polymerization | yes | 30 | 61 | 5 | 9.5 | 5 |
| 2-4 (Comparison) | M-5 | emulsion polymerization | yes | 30 | 53 | 5 | 8.0 | 5 |
| 2-5 (Comparison) | N-1 | suspension polymerization | no | 30 | 95 | 3 | 7.1 | 2 |
| 2-6 (Comparison) | N-2 | suspension polymerization | no | 30 | 72 | 2 | 6.7 | 2 |
| 2-7 (Comparison) | N-3 | suspension polymerization | yes | 30 | 55 | 3 | 5.6 | 3 |
| 2-8 (Comparison) | N-4 | suspension polymerization | yes | 30 | 44 | 3 | 4.4 | 4 |
| 2-9 (Comparison) | N-5 | — | — | 30 | 57 | 1 | 10.5 | 5 |
| 2-10 (Comparison) | N-6 | — | — | 30 | 53 | 1 | 9.0 | 5 |
| 2-11 (Invention) | M-2 | suspension polymerization | yes | 10 | 62 | 5 | 4.0 | 5 |
| 2-12 (Invention) | M-2 | suspension polymerization | yes | 50 | 39 | 5 | 6.6 | 5 |
| 2-13 (Comparison) | N-1 | suspension polymerization | no | 50 | 77 | 2 | 9.0 | 4 |
| 2-14 (Comparison) | N-5 | — | — | 10 | 71 | 1 | 7.5 | 5 |
| 2-15 (Comparison) | N-5 | — | — | 50 | 45 | 1 | 12.1 | 5 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material having provided on a support at least one light-sensitive silver halide emulsion layer and at least one light-sensitive surface layer, in which the non-light-sensitive surface layer contains an organic polymer represented by formula (I) and having a mean grain size of 1.0 μm or more, the polymer being produced by suspension polymerization:

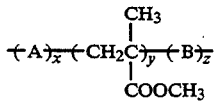

(I)

where

A represents a repeating unit obtained by polymerization of at least one monomer having two or more copolymerizable ethylenic unsaturated groups;

B represents a repeating unit obtained by polymerization of at least one monomer having one copolymerizable ethylenic unsaturated group; and x, y and z each representing a weight percentage, x is a number of from 5 to 15, y is a number of from 70 to 93, and z is a number of from 0 to 25.

2. The silver halide photographic material as claimed in claim 1, which contains a lubricant in an outermost surface layer.

3. The silver halide photographic material as claimed in claim 1, which has at least one electroconductive layer containing an electroconductive substance therein.

4. The silver halide photographic material as claimed in claim 3, in which the electroconductive layer contains a fluorine-containing surfactant along with the electroconductive material.

5. The silver halide photographic material as claimed in claim 1, which further comprises a hydrazine derivative of the following formula (II) or a tetrazolium compound:

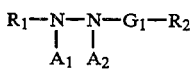

(II)

wherein $R_1$ represents an aliphatic group or an aromatic group;

$R_2$ represents a hydrogen atom, an alkyl group, an aryl group, an alkoxy group, an aryloxy group, an amino group or a hydrazino group;

$G_1$ represents —CO—, —$SO_2$—, —SO—, —P(O)($R_2$)—, —CO—CO—, a thiocarbonyl group or an iminomethylene group; and both $A_1$ and $A_2$ are hydrogen atoms or one of them is a hydrogen atom and the other is a substituted or unsubstituted alkylsulfonyl group, a substituted or unsubstituted arylsulfonyl group, or a substituted or unsubstituted acyl group.

6. The silver halide photographic material as claimed in claim 1, wherein x is a number of from 7 to 15, y is a number of from 70 to 93, and z is a number of from 0 to 23.

* * * * *